US010267145B2

(12) United States Patent
Chanpura et al.

(10) Patent No.: US 10,267,145 B2
(45) Date of Patent: Apr. 23, 2019

(54) INCREASING BOREHOLE WALL PERMEABILITY TO FACILITATE FLUID SAMPLING

(71) Applicant: HALLIBURTON ENERGY SERVICES, INC., Houston, TX (US)

(72) Inventors: Reena Agarwal Chanpura, Sugar Land, TX (US); Reginald Van Mayo, Humble, TX (US); Curtis John Jacks, Katy, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 194 days.

(21) Appl. No.: 15/511,607

(22) PCT Filed: Oct. 17, 2014

(86) PCT No.: PCT/US2014/061180

§ 371 (c)(1),
(2) Date: Mar. 15, 2017

(87) PCT Pub. No.: WO2016/060689

PCT Pub. Date: Apr. 21, 2016

(65) Prior Publication Data

US 2017/0248014 A1 Aug. 31, 2017

(51) Int. Cl.
*E21B 49/08* (2006.01)
*E21B 47/00* (2012.01)
(Continued)

(52) U.S. Cl.
CPC ..... *E21B 49/08* (2013.01); *E21B 43/11* (2013.01); *E21B 43/119* (2013.01); *E21B 47/00* (2013.01)

(58) Field of Classification Search
CPC ..... E21B 49/10; E21B 43/119; E21B 43/11; E21B 47/00
See application file for complete search history.

(56) References Cited

U.S. PATENT DOCUMENTS 4,936,139 A 6/1990 Zimmerman et al.
5,065,619 A * 11/1991 Myska ..... E21B 47/06 166/250.07

(Continued)

FOREIGN PATENT DOCUMENTS

WO 2006/093492 11/2006

OTHER PUBLICATIONS

PCT International Search Report and Written Opinion, dated Jun. 30, 2015, Appl No. PCT/US2014/061180, "Increasing Borehole Wall Permeability to Facilitate Fluid Sampling," Filed Oct. 17, 2014, 14 pgs.

(Continued)

*Primary Examiner* — Wei Wang
(74) *Attorney, Agent, or Firm* — Gilliam IP PLLC

(57) ABSTRACT

A drill string tool assembly, in some embodiments, comprises a punching tool that induces fissures to increase permeability in a localized region of a borehole wall. The assembly also comprises a sensor that detects spatial features of the fissures and processing logic, coupled to the sensor and punching tool, that adapts operation of the punching tool based on the spatial features. The assembly further comprises a fluid sampling probe, coupled to the processing logic, that samples fluid from the localized region.

20 Claims, 8 Drawing Sheets

(51) Int. Cl.

| | |
|---|---|
| ***E21B 43/11*** | (2006.01) |
| ***E21B 43/119*** | (2006.01) |

(56) References Cited

U.S. PATENT DOCUMENTS

| | | | | |
|---|---|---|---|---|
| 5,156,205 | A | 10/1992 | Prasad | |
| 5,509,482 | A | 4/1996 | Dillon et al. | |
| 5,692,565 | A | 12/1997 | MacDougall et al. | |
| 6,325,146 | B1 | 12/2001 | Ringgenberg et al. | |
| 6,330,913 | B1 | 12/2001 | Langseth et al. | |
| 6,581,685 | B2 | 6/2003 | Burgess et al. | |
| 6,588,266 | B2 | 7/2003 | Tubel et al. | |
| 6,691,037 | B1 | 2/2004 | Poe et al. | |
| 6,828,547 | B2 | 12/2004 | Tubel et al. | |
| 7,191,831 | B2 | 3/2007 | Reid et al. | |
| 7,278,480 | B2 | 10/2007 | Longfield et al. | |
| 7,347,262 | B2 | 3/2008 | Tarvin et al. | |
| 7,490,664 | B2 | 2/2009 | Skinner et al. | |
| 7,644,611 | B2 | 1/2010 | Akira | |
| 7,703,317 | B2 | 4/2010 | Goodwin et al. | |
| 7,784,339 | B2 | 8/2010 | Cook | |
| 8,162,052 | B2 | 4/2012 | Goodwin et al. | |
| 8,245,781 | B2 | 8/2012 | Ciglenec et al. | |
| 8,621,920 | B2 | 1/2014 | Reid et al. | |
| 2003/0056950 | A1 | 3/2003 | Burgess et al. | |
| 2005/0016727 | A1 | 1/2005 | Fields | |
| 2008/0066535 | A1* | 3/2008 | Vasques | E21B 33/1246 73/152.17 |
| 2010/0059221 | A1 | 3/2010 | Vannuffelen et al. | |
| 2010/0186948 | A1 | 7/2010 | Sonne et al. | |
| 2010/0189648 | A1 | 7/2010 | Huang et al. | |
| 2011/0107830 | A1 | 5/2011 | Fields et al. | |
| 2011/0297371 | A1 | 12/2011 | Church et al. | |
| 2014/0131045 | A1 | 5/2014 | Loiseau et al. | |

OTHER PUBLICATIONS

PCT Internationalpreliminary Report on Patentability, dated Dec. 1, 2016, Appl No. PCT/US2014/061180, "Increasing Borehole Wall Permeability to Facilitate Fluid Sampling," Filed Oct. 17, 2014, 16 pgs.

Ayan, Cosan et al., "Characterizing Permeability with Formation testers," Oilfield Review, Autumn 2001, pp. 2-23, Schlumberger Limited, Houston, Texas, United States.

Proett, Mark A., et al., "New Wireline Formation Testing Tool With Advanced Sampling Technology," SPE Reservoir Evaluation & Engineering Presentation, Apr. 2001, pp. 76-87, Society of Petroleum Engineers, Richardson, Texas, United States.

Schlumberger, Limited, "MDT Modular Formation Dynamics Tester," www.slb.com, 2014, Retrieved from the Internet on Jul. 18, 2014, Available at: http://www.s1b.com/services/characterization/reservoir/wireline/modular_formation_dynamics_tester.aspx.

Wheat, C G. et al., "Fluid sampling from oceanic borehole observatories: design and methods for CORK activities (1990-2010)," Fluid-sampling systems, Proceedings of the Integrated Ocean Drilling Program, 2011, vol. 327, Integrated Ocean Drilling Program Management International, Inc., Tokyo, Japan.

Canadian Application Serial No. 2,961,722, First Office Action; dated Mar. 19, 2018, 4 pages.

* cited by examiner

INCREASING BOREHOLE WALL PERMEABILITY TO FACILITATE FLUID SAMPLING

BACKGROUND

Subsurface formations contain reservoir fluid which, when sampled and analyzed, may provide useful information about the formation. For example, fluid analysis results can be used to perform reservoir correlations and simulations and to optimize wellbore placement and generate production forecasts. Fluid is typically sampled using a probe that is extended from a downhole tool assembly and pressed against a borehole wall. Ideally, when a probe is pressed against an area of a formation that is highly permeable, fluid is pumped out from the formation and into the probe. Low permeability areas of a formation, however, make fluid flow and collection difficult.

BRIEF DESCRIPTION OF THE DRAWINGS

Accordingly, there are disclosed in the accompanying drawings and in the following description methods and systems for increasing borehole wall permeability to facilitate fluid sampling. In the drawings.

DETAILED DESCRIPTION

The methods and systems disclosed herein entail the use of a punching tool to punch a target area of a borehole wall, thereby inducing and/or enhancing fissures throughout a localized region. These fissures increase the permeability of the localized region. The methods and systems further comprise repositioning the drill string tool assembly until a fluid sampling probe aligns with the fissured, localized region and extending the probe toward the localized region to sample fluid. Alternatively, in lieu of repositioning the tool assembly, the methods and systems comprise punching the localized region until the fissured, localized region is aligned with the fluid sampling probe. The probe is then extended for sampling.

Figure 1:
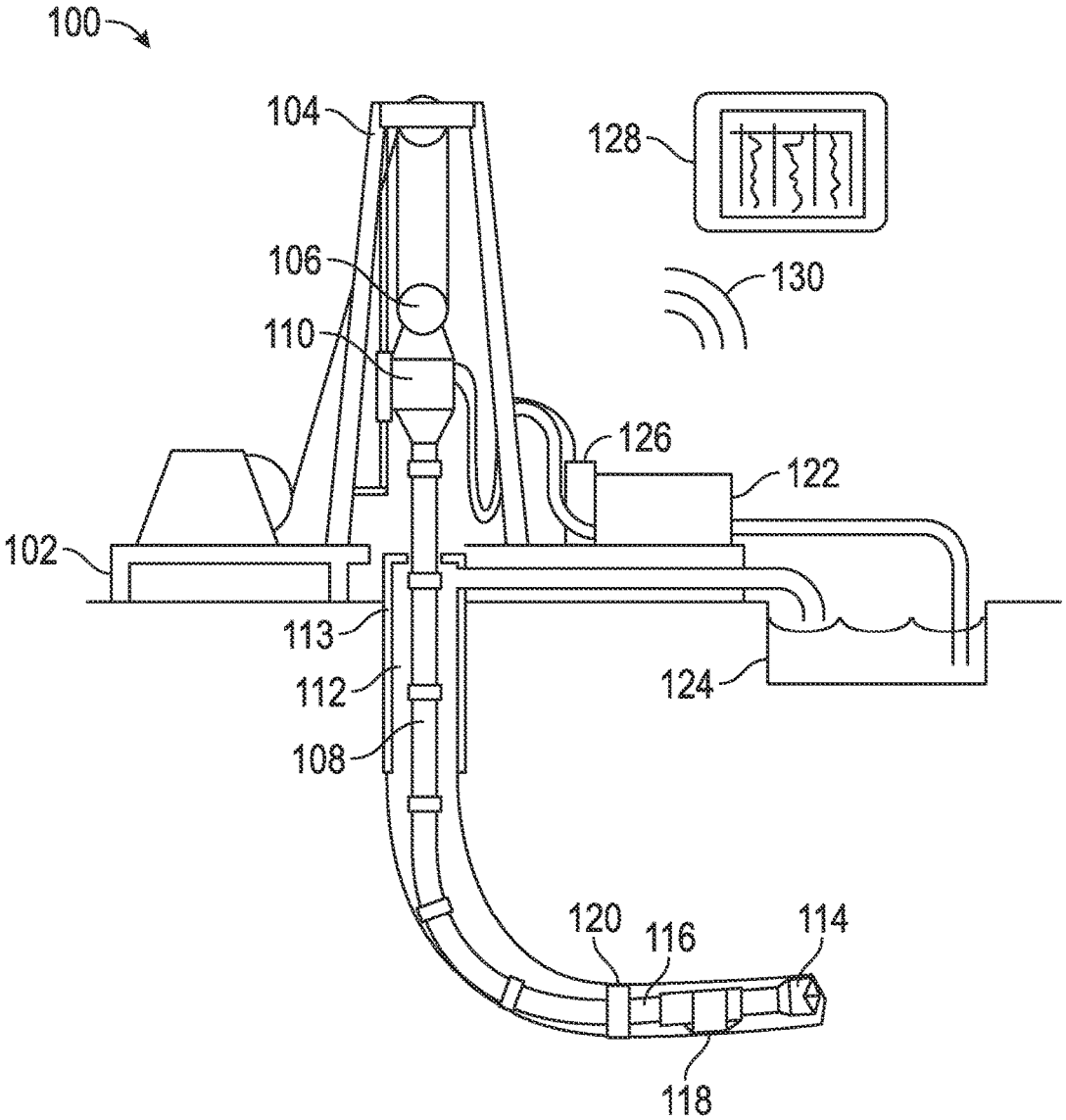
FIG. 1 is a schematic view of an illustrative drilling environment, in accordance with embodiments.

FIG. 1 is a schematic view of an illustrative drilling environment 100 in which the systems and methods disclosed herein may be implemented. The drilling environment 100 comprises a drilling platform 102 that supports a derrick 104 having a traveling block 106 for raising and lowering a drill string 108. A top-drive motor 110 (or, in other embodiments, a rotary table) supports and turns the drill string 108 as it is lowered into the borehole 112. The drill string's rotation, alone or in combination with the operation of a downhole motor, drives the drill bit 114 to extend the borehole. The drill bit 114 is one component of a bottomhole assembly (BHA) 116 that may further include a rotary steering system (RSS) 118 and stabilizer 120 (or some other form of steering assembly) along with drill collars and logging instruments. A pump 122 circulates drilling fluid through a feed pipe to the top drive 110, downhole through the interior of drill string 108, through nozzles in the drill bit 114, back to the surface via the annulus around the drill string 108, and into a retention pit 124. The drilling fluid transports drill cuttings from the borehole 112 into the retention pit 124 and aids in maintaining the integrity of the borehole. An upper portion of the borehole 112 is stabilized with a casing string 113 and the lower portion being drilled is an open (uncased) borehole.

The drill collars in the BHA 116 are typically thick-walled steel pipe sections that provide weight and rigidity for the drilling process. The thick walls are also convenient sites for installing logging instruments that measure downhole conditions, various drilling parameters, and characteristics of the formations penetrated by the borehole. The BHA 116 typically further includes a navigation tool having instruments for measuring tool orientation (e.g., multi-component magnetometers and accelerometers), depth and a control sub with a telemetry transmitter and receiver. The control sub coordinates the operation of the various logging instruments, steering mechanisms, and drilling motors, in accordance with commands received from the surface, and provides a stream of telemetry data to the surface as needed to communicate relevant measurements and status information. A corresponding telemetry receiver and transmitter is located on or near the drilling platform 102 to complete the telemetry link. The most widely used telemetry link is based on modulating the flow of drilling fluid to create pressure pulses that propagate along the drill string ("mud-pulse telemetry or MPT"), but other known telemetry techniques are suitable. Much of the data obtained by the control sub may be stored in memory for later retrieval, e.g., when the BHA 116 physically returns to the surface.

A surface interface 126 serves as a hub for communicating via the telemetry link and for communicating with the various sensors and control mechanisms on the platform 102. A data processing unit (shown in FIG. 1 as a tablet computer 128) communicates with the surface interface 126 via a wired or wireless link 130, collecting and processing measurement data to generate logs and other visual representations of the acquired data and the derived models to facilitate analysis by a user. The data processing unit may take many suitable forms, including one or more of: an embedded processor, a desktop computer, a laptop computer, a central processing facility, and a virtual computer in the cloud. In each case, software on a non-transitory information storage medium may configure the processing unit to carry out the desired processing, modeling, and display generation.

Figure 2:
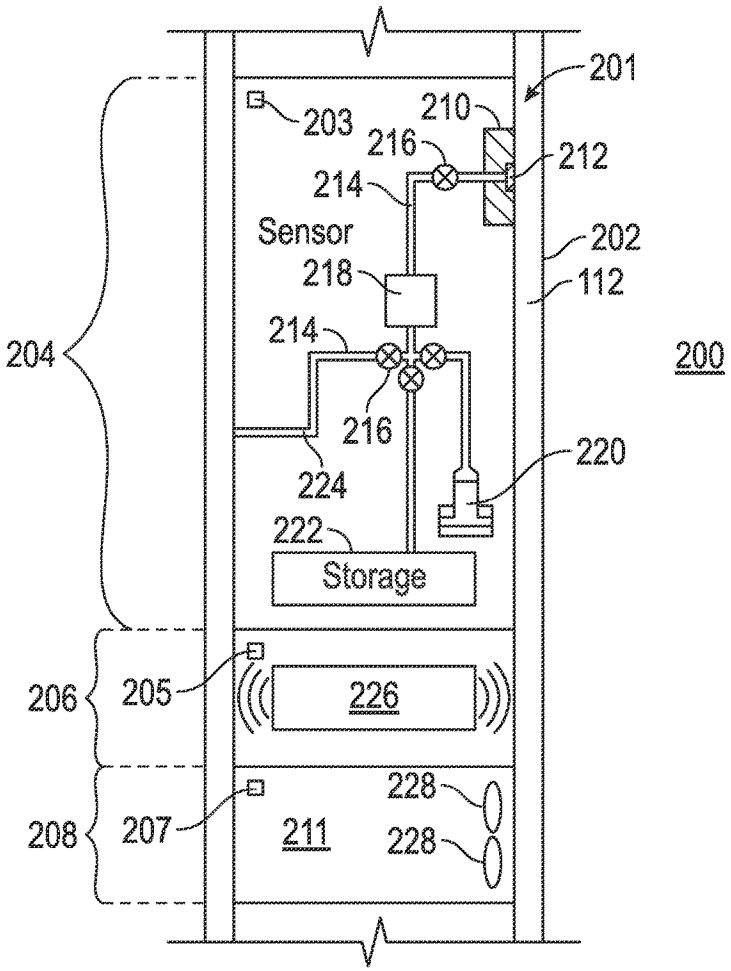
FIG. 2 is a schematic view of an illustrative drill string tool assembly, in accordance with embodiments.

FIG. 2 is a schematic view of an illustrative drill string tool assembly 201 in accordance with embodiments. The assembly 201 is disposed within the borehole 112, which is formed in the formation 200. The assembly 201 comprises multiple subs 204, 206 and 208. Sub 204 houses a fluid sampling system comprising a cup-shaped sealing pad 210, a fluid sampling probe 212, flow lines 214, valves 216, a fluid density sensor 218, a piston pump 220, a multi-chamber fluid sample storage 222, fluid exhaust 224, spatial feature sensor 226, and punching tool 211. In some embodiments, the aforementioned control sub communicates directly with and controls equipment housed in each of the subs 204, 206 and 208. In other embodiments, each sub houses a separate processing logic 203, 205 or 207 that controls the equipment within that sub. In such embodiments, the processing logic in each sub may communicate directly or indirectly with the control sub, with processing logic or equipment in other subs, and/or with the processing unit (e.g., tablet computer 128). Regardless of the precise configuration of the processing logic and the control sub, some or all of the hardware and/or software used to control the systems and perform the methods described herein are collectively referred to as "processing logic." Additionally, although the drawings show the fluid sampling system, spatial feature sensor 226 and punching tool 211 being distributed among multiple subs, in some embodiments, the equipment may be housed within a single sub.

When triggered, the punching tool 211 induces fissures in a localized region of the borehole wall 202. As used herein, the term "localized region" refers to an area of a formation that experiences an increase in permeability as a result of one or more punches by the punching tool 211. In some embodiments, the punching tool 211 comprises a perforating gun. In such embodiments, the punching tool 211 comprises gun charges 228 that produce controlled explosions to punch the borehole wall 202. In some embodiments, the gun charges 228 are physically oriented with a zero degree gun phasing, meaning that in vertical boreholes, all charges 228 are vertically aligned along the length of the tool assembly 201, and in horizontal boreholes, all charges are horizontally aligned along the length of the tool assembly 201. The gun charges 228 may be phased in any manner suitable for punching the formation 200. The punching tool 211 may alternatively comprise a laser, a steam or fluid jet, a heating device, a hammer, a hydraulic ram or any other suitable device.

The spatial feature sensor 226 detects fissures and their spatial features, such as length, width, height, position, direction, concentration, total number, average volume, and/or total volume. Thus, the spatial feature sensor 226 is able to detect and characterize fissures induced by the punching tool 211 and helps to determine whether a localized region of the formation has been adequately fissured for fluid sampling purposes. In some embodiments, the spatial feature sensor 226 comprises a fiber optics sensor. Other types of sensors, such as electromagnetic sensors, also may be used. Ultrasonic and microwave echo transducers may be employed to measure fine features associated with the presence of fissures. NMR tools can similarly detect fissure presence and size. Larger-scale features associated with fissures may be monitored using resistivity sensors and sonic velocity sensors.

In operation, the sealing pad 210 and fluid sampling probe 212 extend away from the tool assembly 201 to make contact with the area of the formation 200—and, more particularly, borehole wall 202—from which fluid is to be sampled. Once the sealing pad 210 makes contact with the borehole wall 202 and forms a seal with the wall, the piston pump 220—which couples with the fluid sampling probe 212—forms a pressure differential and pumps formation fluid in from the formation via the probe 212. With the cooperation of an arrangement of valves 216, the piston pump 220 regulates a flow of various fluids in and out of the formation sampling system via the flow lines 214. The fluid density sensor 218 measures the density of fluid flowing through the flow lines 214. The sensor 218 identifies formation fluid that is contaminated (e.g., by borehole fluid seeping into highly permeable areas of the borehole wall 202), and such contaminated fluid is exhausted to the borehole 112 via the fluid exhaust 224. Once the flow of formation fluid reaches a steady state density, it is routed to the storage 222 for collection.

Figure 3A:
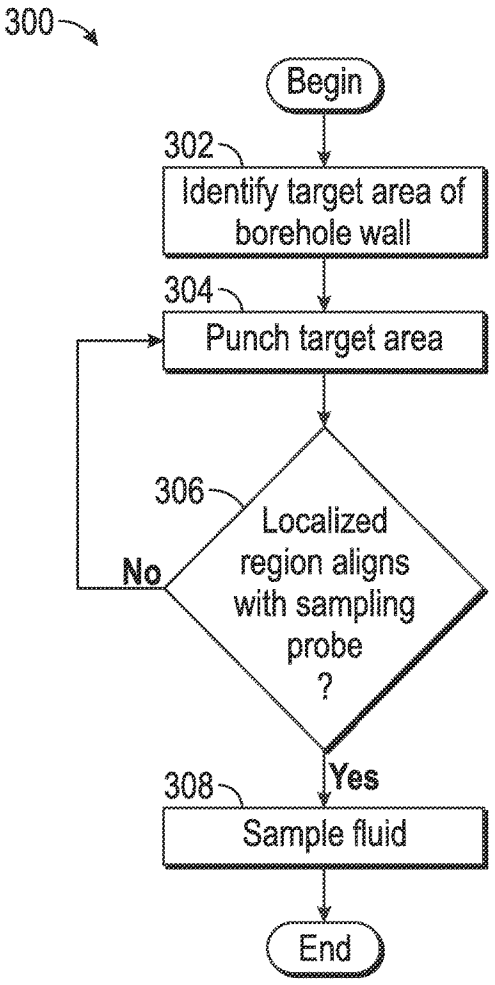
FIG. 3A is a flow diagram of an illustrative method for increasing the permeability of a borehole wall, in accordance with embodiments.
Figure 3C:
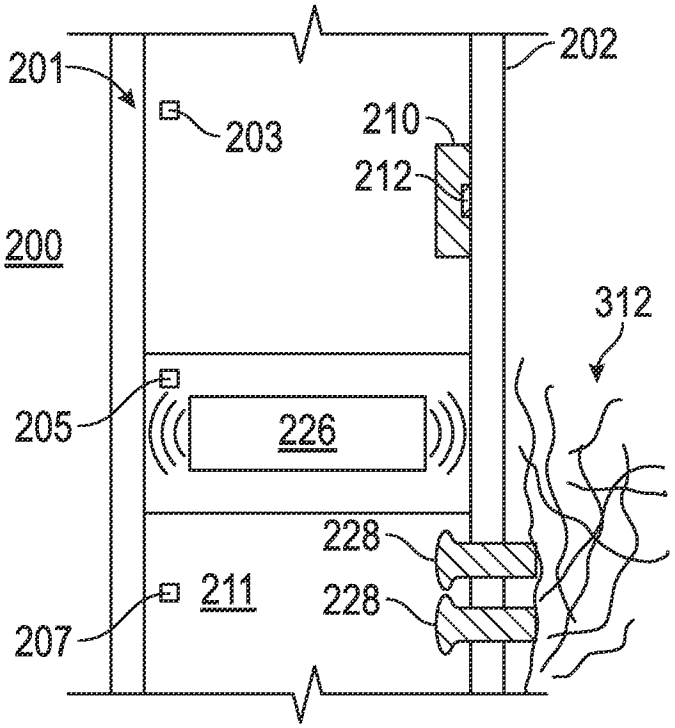
FIGS. 3B-3F are schematic views of an illustrative drill string tool assembly performing the method of FIG. 3A, in accordance with embodiments.
Figure 3B:
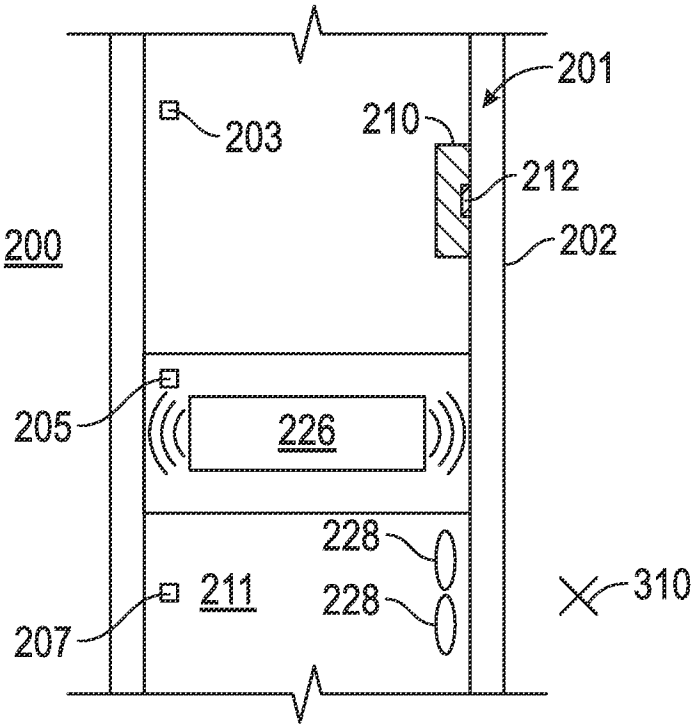

FIG. 3A is a flow diagram of an illustrative method 300 for increasing the permeability of a borehole wall. Processing logic (e.g., one or more of processing logic 203, 205 and/or 207) performs the method 300 during a drilling process, meaning that the steps of method 300 may be performed when the drill bit 114 (FIG. 1) is operational, during periods when the drill bit 114 is temporarily stopped, or both. Method 300 is now described in light of FIGS. 3B-3F, which constitute an illustrative implementation of the method 300. The method 300 comprises identifying a target area of a borehole wall from which formation fluid is to be extracted (step 302). The target area may be identified by drilling personnel considering various factors, such as target area depth and permeability based on surface logs, adjacent well logs and other relevant data. FIG. 3B illustrates this step and denotes the target area of the formation with numeral 310. As shown, the punching tool 211—and, in particular, gun charges 228—are in proximity to the target area 310.

The method 300 then comprises punching the target area 310 using the punching tool 211 (step 304). The precise technique by which the target area is punched varies according to the punching tool 211 used. In the embodiment illustrated in FIG. 3C, punching is performed using perforation gun charges 228, as shown. The punch induces fissures in localized region 312, thereby increasing the permeability of the region 312. As explained, the localized region 312 is a region in the formation 200 that experiences an increase in permeability due to punches by the punching tool 211.

The method 300 also comprises determining whether the localized region—i.e., the region of the formation that has increased permeability as a result of the punching in step 304—aligns with the fluid sampling probe (step 306). A localized region is aligned with the fluid sampling probe if a plane of the fluid sampling probe that is orthogonal to the axis of the tool assembly coincides with the localized region. In addition, in some embodiments, whether a probe and a localized region are aligned depends on whether one or more fissures in the localized region are sufficiently close to the borehole wall 202 so that the fluid is accessible to the sampling probe. Sensor 226 performs this detection step 306 using any of a variety of known techniques to identify the spatial features of the fissures (e.g., length, width, height, position, direction, concentration, total number, average volume, and/or total volume) in the localized region 312. As dashed line 314 indicates in FIG. 3D, the fluid sampling probe 212 does not align with the localized region 312. Specifically, the localized region 312 is farther downhole than the fluid sampling probe 212. Thus, were the probe 212 extended to the formation 200, it would not benefit from the increased permeability of localized region 312.

Figure 3E:
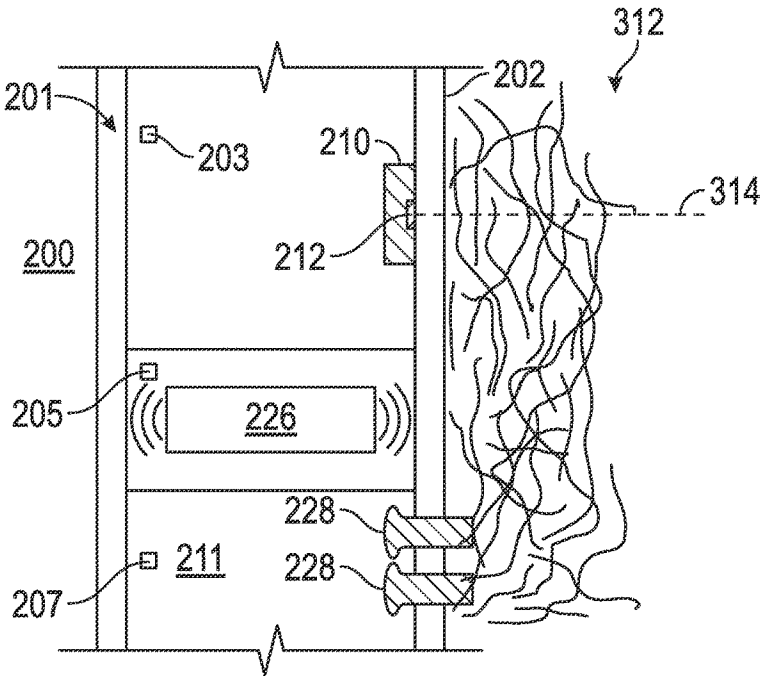
Figure 3D:
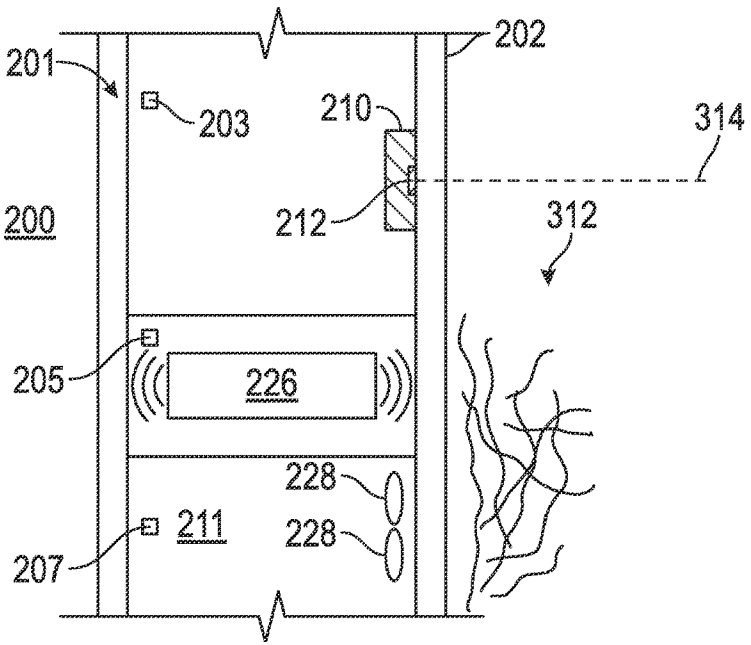

If the result of the determination at step 306 is that the localized region does not align with the sampling probe, the method 300 further comprises repeating steps 304 and 306 until the localized region does align with the sampling probe. FIG. 3E illustrates this repeated punching process, in which gun charges 228 punch the formation 200 such that the localized region 312 increases in size until it aligns with the fluid sampling probe 212, as dashed line 314 indicates.

Figure 3F:
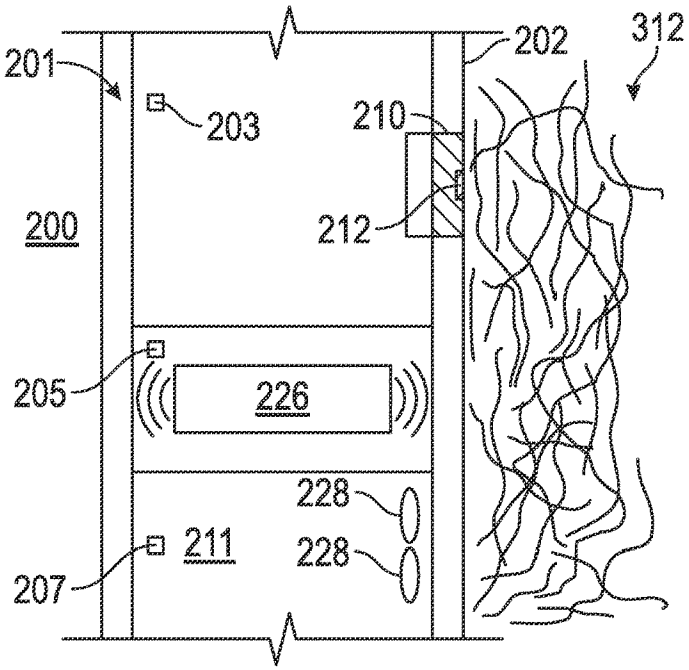

When the result of the determination at step 306 is that the localized region aligns with the sampling probe, the method 300 comprises sampling the formation fluid (step 308). FIG. 3F illustrates such sampling, in which the sealing pad 210 extends away from the tool assembly 201 and toward the borehole wall 202 until it forms a seal with the wall 202. In some embodiments, rams (not specifically shown) are extended from the opposite side of the tool assembly so that the pad 210 is forced into a sealing contact with the borehole wall 202. The probe 212 then samples the fluid as described above. In this way, the tool assembly 201 increases the size of the localized region 312 until the region is accessible to the sampling probe 212, thereby making it unnecessary to reposition the tool assembly 201 to align the probe 212 and localized region 312.

Figure 4A:
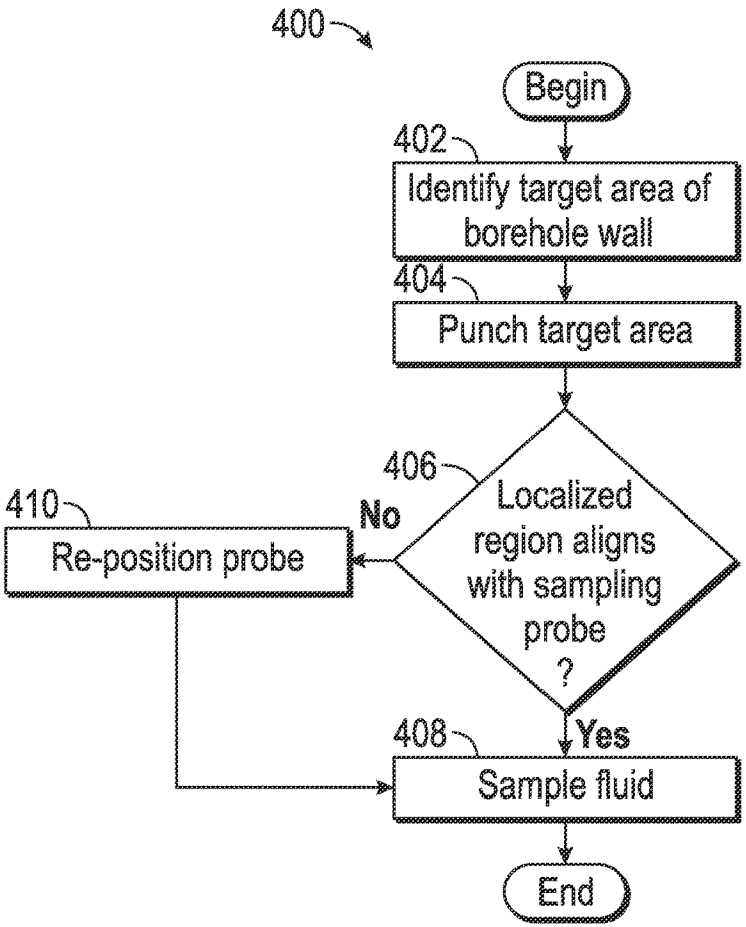
FIG. 4A is a flow diagram of another illustrative method for increasing the permeability of a borehole wall, in accordance with embodiments.
Figure 4C:
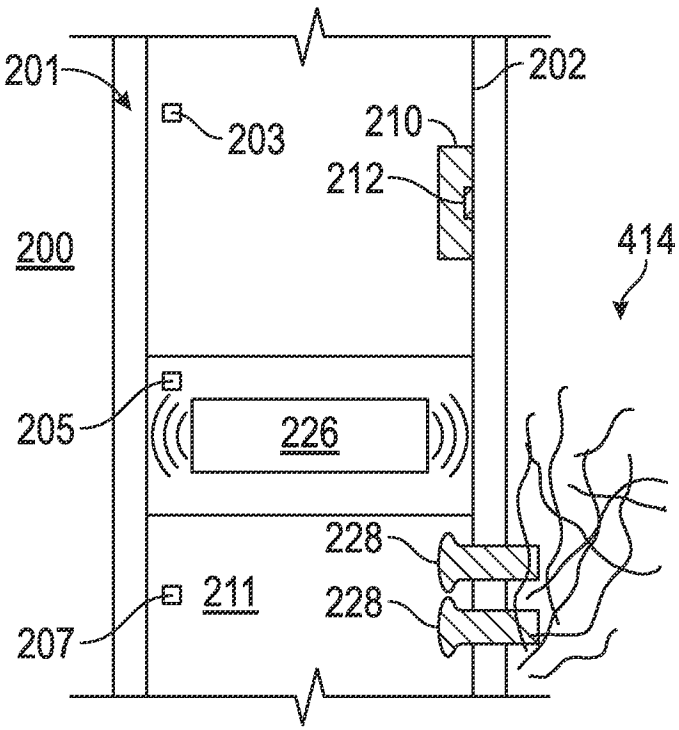
FIGS. 4B-4F are schematic views of an illustrative drill string tool assembly performing the method of FIG. 4A, in accordance with embodiments.
Figure 4B:
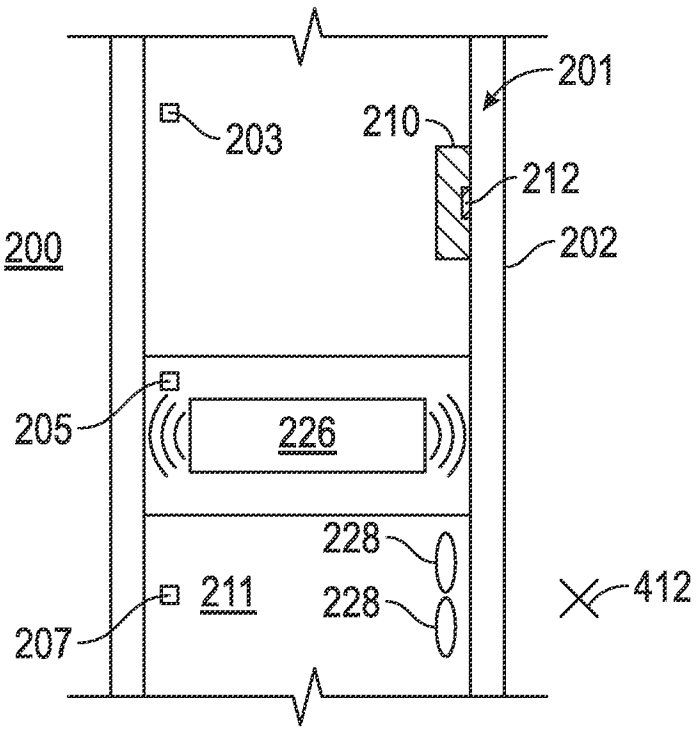

In some embodiments, however, the tool assembly 201 may be repositioned in lieu of repeated punching—for instance, in cases where additional punching would negatively affect the integrity of the borehole wall 202. FIG. 4A shows an illustrative method 400 for increasing formation permeability in accordance with such embodiments. Processing logic (e.g., one or more of processing logic 203, 205 and/or 207) performs the method 400 during the drilling process, meaning that the steps of method 400 may be performed when the drill bit 114 (FIG. 1) is operational, during periods when the drill bit 114 is temporarily stopped, or both. Method 400 is now described in light of FIGS. 4B-4F, which constitute an illustrative implementation of the method 400. The method 400 begins by identifying a target area of the borehole wall (step 402). FIG. 4B illustrates the target area using numeral 412. The method 400 further comprises punching the target area 412 (step 404). FIG. 4C illustrates the gun charges 228 of punching tool 211 punching the target area to produce localized region 414. As explained, the localized region 414 is the area of the formation that increases in permeability due to the punching tool 211.

Method 400 then comprises determining whether the localized region 414 aligns with the fluid sampling probe 212 (step 406). In some embodiments, whether a probe and a localized region are aligned depends on whether one or more fissures in the localized region are sufficiently close to the borehole wall 202 so that the fluid is accessible to the sampling probe. Sensor 226 performs this detection step using any of a variety of known techniques to identify the spatial features of the fissures (e.g., length, width, height, position, direction, concentration, total number, average volume, and/or total volume) in the localized region 414.

Figure 4E:
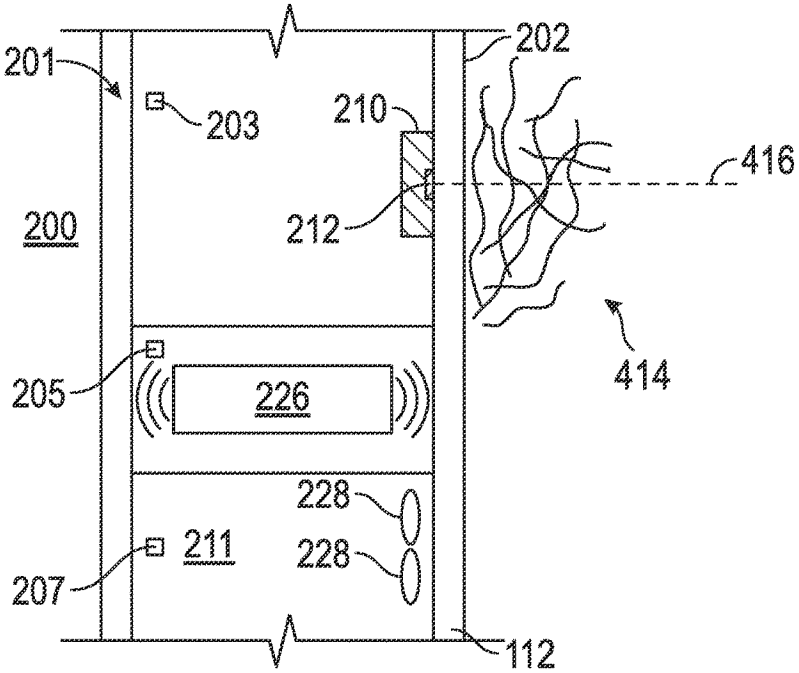
Figure 4D:
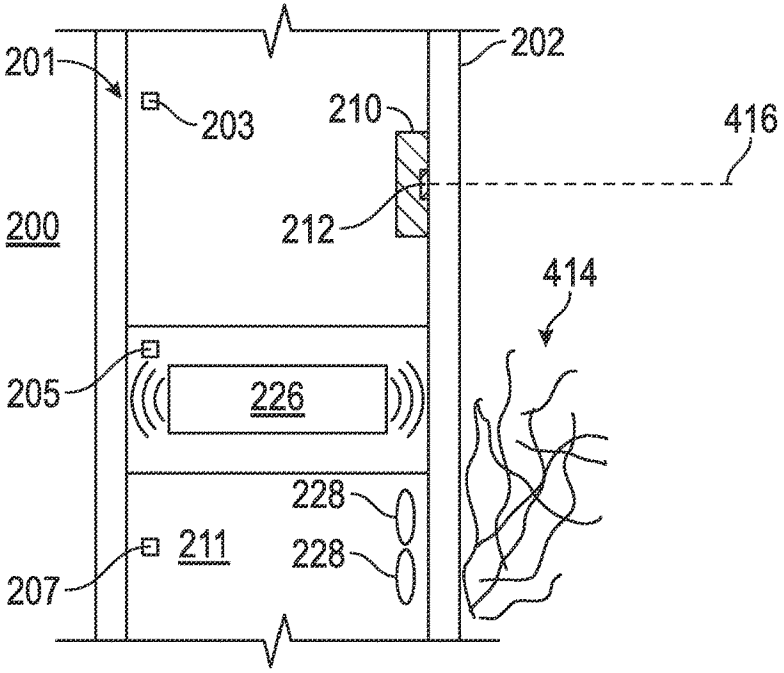

FIG. 4D illustrates the case in which the localized region 414 does not align with the fluid sampling probe 212, as dashed line 416 denotes. In such cases, the method 400 comprises repositioning the fluid sampling probe 212 (step 410). FIG. 4E illustrates such a repositioning of the probe 212, in which the entire tool assembly 201—that is, the drill string itself—is repositioned within the borehole 112 such that the probe 212 aligns with the localized region 414, as dashed line 416 denotes. Step 410 is performed in lieu of repeated punching of the target area. In some embodiments, the fluid sampling probe 212 is repositioned by a distance less than that between the position of the probe 212 (i.e., prior to repositioning) and the punching tool 211. Stated another way, in some embodiments, the fluid sampling probe 212 is repositioned by the minimum distance necessary for the probe 212 to access fluid-containing fissures in the localized region 414.

Figure 4F:
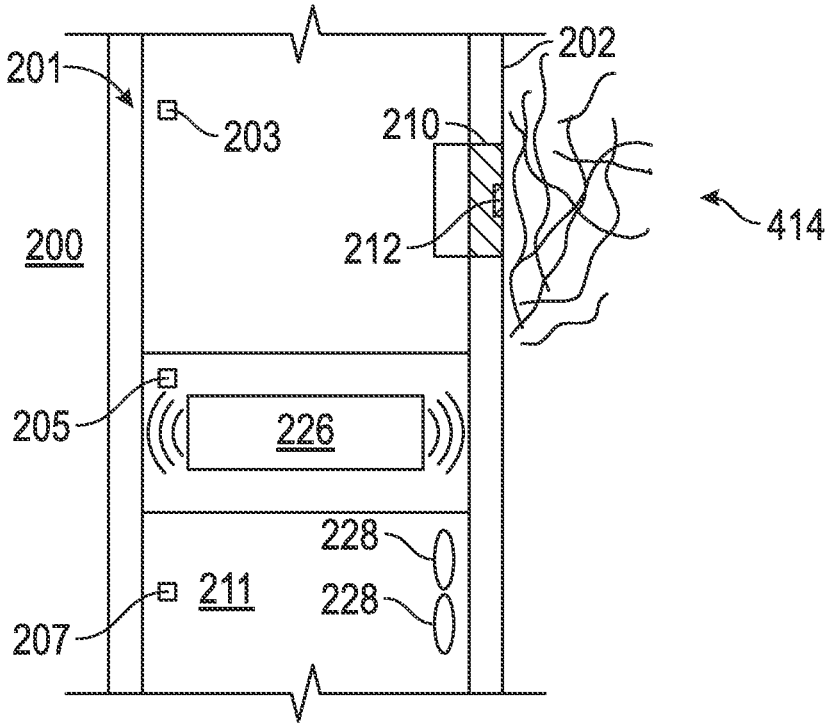

Regardless of the determination at step 406, the method 400 concludes by sampling the formation fluid (step 408). FIG. 4F illustrates such sampling, in which the sealing pad 210 is extended away from the tool assembly 201 and toward the borehole wall 202 until the pad forms a seal with the wall 202. Rams are optionally used to enhance the seal, as described above with respect to method 300. The fluid sampling probe 212 then samples fluid as described above.

Some embodiments comprise both the repeated punching of the borehole wall as well as the repositioning of the tool assembly. Generally, in such embodiments, the greater the number and/or force of punches delivered to the formation, the greater the size of the fissured, localized region and the smaller the distance that the tool assembly must subsequently be repositioned to ensure alignment of the fluid sampling probe and the localized region.

Numerous other variations and modifications will become apparent to those skilled in the art once the above disclosure is fully appreciated. For example, the steps shown in methods 300 and 400 are merely illustrative, and various additions, deletions and other modifications may be made as desired and appropriate. Moreover, the systems and methods disclosed herein may be used to obtain additional, useful information. For instance, processing logic may compare the force with which a punching tool 211 punches a borehole wall 202 to the increase in permeability in the punched area (e.g., as determined by sensor 226) to draw conclusions about the formation at the site of punching—for instance, to determine a permeability level relative to other, similarly punched areas. Similarly, the illustrative implementations described herein (e.g., with respect to FIG. 1) are merely exemplary; any and all other such implementations also fall within the scope of this disclosure. It is intended that the following claims be interpreted to embrace all such variations, modifications and equivalents. In addition, the term "or" should be interpreted in an inclusive sense.

The present disclosure encompasses numerous embodiments. At least some of these embodiments are directed to a drill string tool assembly that comprises a punching tool that induces fissures to increase permeability in a localized region of a borehole wall. The assembly also comprises a sensor that detects spatial features of the fissures and processing logic, coupled to the sensor and punching tool, that adapts operation of the punching tool based on the spatial features. The assembly further comprises a fluid sampling probe, coupled to the processing logic, that samples fluid from the localized region.

In addition, at least some of the embodiments are directed to a method that comprises punching a formation to create fissures in a localized portion of the formation until at least one of the fissures aligns with a fluid sampling probe, sampling formation fluid from the localized portion, and storing the formation fluid in a drill string tool assembly.

Further, at least some of the embodiments are directed to a method that comprises punching a borehole wall to create fissures in a localized region of a formation, sensing spatial features of the localized region, and using the spatial features to adjust a position of a fluid sampling probe such that the probe is aligned with the localized region.

The foregoing embodiments may be supplemented in any of a variety of ways, including by adding any of the following, in any sequence and in any combination: The drill string tool assembly processing logic determines when the fluid sampling probe is aligned with the localized region and triggers operation of the fluid sampling probe when it is so aligned. The drill string tool assembly processing logic repositions the tool assembly to align the fluid sampling probe with the localized region. The drill string tool assembly sensor is selected from the group consisting of a fiber optic sensor and an electromagnetic sensor. The drill string tool assembly is contained within a single drill string sub. The drill string tool assembly punching tool is selected from the group consisting of a perforation gun, a laser, a steam jet, a fluid jet, a heating device, a hydraulic ram and a hammer. The drill string tool assembly punching tool induces fissures during a drilling operation, and the fluid sampling probe also samples the fluid during the drilling operation. The methods may further comprise determining properties associated with the localized portion by considering a force with which the formation is punched. The methods may comprise using either a fiber optic sensor or an electromagnetic sensor to punch the formation until at least one of the fissures aligns with the fluid sampling probe. In at least some of the methods, the drill string tool assembly is contained within a single drill string sub. In at least some of the methods, the punching comprises using a tool selected from the group consisting of a perforation gun, a laser, a steam jet, a fluid jet, a heating device, a hydraulic ram and a hammer. The methods may further comprise performing the punching and the sampling during a drilling operation. In at least some of the methods, adjusting the position of the fluid sampling probe comprises re-positioning the probe by a distance less than that between the probe and a punching tool used for the punching. In at least some of the methods, sensing comprises using either a fiber optic sensor or an electromagnetic sensor. At least some of the methods further comprise housing the fluid sampling probe and a punching tool used for the punching within a single drill string sub. At least some of the methods further comprise sampling fluid from the localized region during a drilling operation. At least some of the methods further comprise again punching the borehole wall to increase a size of the localized region.

The following is claimed:

1. A drill string tool assembly, comprising:

a punching tool that induces fissures to increase permeability in a localized region of a borehole wall;

a sensor that detects spatial features of the fissures;

processing logic, coupled to the sensor and punching tool, that adapts operation of the punching tool based on said spatial features; and a fluid sampling probe, coupled to the processing logic, that samples fluid from the localized region.

2. The drill string tool assembly of claim 1, wherein the processing logic determines when the fluid sampling probe is aligned with the localized region and triggers operation of the fluid sampling probe when it is so aligned.

3. The drill string tool assembly of claim 1, wherein the processing logic repositions the tool assembly to align the fluid sampling probe with the localized region.

4. The drill string tool assembly of claim 1, wherein the sensor is selected from the group consisting of a fiber optic sensor and an electromagnetic sensor.

5. The drill string tool assembly of claim 1, wherein the drill string tool assembly is contained within a single drill string sub.

6. The drill string tool assembly of claim 1, wherein the punching tool is selected from the group consisting of a perforation gun, a laser, a steam jet, a fluid jet, a heating device, a hydraulic ram and a hammer.

7. The drill string tool assembly of claim 1, wherein the punching tool induces said fissures during a drilling operation, and wherein the fluid sampling probe also samples the fluid during said drilling operation.

8. A method, comprising:

punching a formation to create fissures in a localized portion of the formation until at least one of said fissures aligns with a fluid sampling probe;

sampling formation fluid from the localized portion; and storing said formation fluid in a drill string tool assembly.

9. The method of claim 8, further comprising determining properties associated with the localized portion by considering a force with which the formation is punched.

10. The method of claim 8, wherein punching the formation until at least one of said fissures aligns with the fluid sampling probe comprises using either a fiber optic sensor or an electromagnetic sensor.

11. The method of claim 8, wherein the drill string tool assembly is contained within a single drill string sub.

12. The method of claim 8, wherein said punching comprises using a tool selected from the group consisting of a perforation gun, a laser, a steam jet, a fluid jet, a heating device, a hydraulic ram and a hammer.

13. The method of claim 8, further comprising performing said punching and said sampling during a drilling operation.

14. A method, comprising:

punching a borehole wall to create fissures in a localized region of a formation;

sensing spatial features of the localized region; and using the spatial features to adjust a position of a fluid sampling probe such that the probe is aligned with the localized region.

15. The method of claim 14, wherein adjusting said position comprises re-positioning the probe by a distance less than that between the probe and a punching tool used for said punching.

16. The method of claim 14, further comprising comparing a force used to punch said borehole wall with said sensed spatial features to determine information about said localized region.

17. The method of claim 14, wherein said sensing comprises using either a fiber optic sensor or an electromagnetic sensor.

18. The method of claim 14, further comprising housing the fluid sampling probe and a punching tool used for said punching within a single drill string sub.

19. The method of claim 14, further comprising sampling fluid from the localized region during a drilling operation.

20. The method of claim 14, further comprising again punching the borehole wall to increase a size of the localized region.

* * * * *